US011492186B2

(12) United States Patent
Kohara et al.

(10) Patent No.: US 11,492,186 B2
(45) Date of Patent: Nov. 8, 2022

(54) CONTAINER BAG MADE OF SHEET MATERIAL

(71) Applicant: DAIWA CAN COMPANY, Chiyoda-ku (JP)

(72) Inventors: Hidetomo Kohara, Sagamihara (JP); Tsuyoshi Kawabata, Sagamihara (JP); Susumu Sato, Sagamihara (JP); Haruka Yajima, Sagamihara (JP)

(73) Assignee: DAIWA CAN COMPANY, Chiyoda-ku (JP)

( * ) Notice: Subject to any disclaimer, the term of this patent is extended or adjusted under 35 U.S.C. 154(b) by 0 days.

(21) Appl. No.: 17/271,471

(22) PCT Filed: Aug. 23, 2019

(86) PCT No.: PCT/JP2019/033000
§ 371 (c)(1),
(2) Date: Feb. 25, 2021

(87) PCT Pub. No.: WO2020/045270
PCT Pub. Date: Mar. 5, 2020

(65) Prior Publication Data

US 2021/0309429 A1 Oct. 7, 2021

(30) Foreign Application Priority Data

Aug. 27, 2018 (JP) ..... JP2018-158163

(51) Int. Cl.
*B65D 75/26* (2006.01)
*B65D 75/00* (2006.01)
(Continued)

(52) U.S. Cl.
CPC ..... *B65D 75/26* (2013.01); *B65D 75/008* (2013.01); *B65D 75/5883* (2013.01); *B65D 81/3893* (2013.01)

(58) Field of Classification Search
CPC .. B65D 75/26; B65D 75/008; B65D 75/5833; B65D 81/3893
(Continued)

(56) References Cited

U.S. PATENT DOCUMENTS 5,351,828 A 10/1994 Becker et al.
5,753,895 A * 5/1998 Olson ..... B65D 65/14 219/730
(Continued)

FOREIGN PATENT DOCUMENTS

CN 1478043 A 2/2004
CN 1481326 A 3/2004
(Continued)

OTHER PUBLICATIONS

International Search Report dated Nov. 26, 2019 in PCT/JP2019/033000 filed on Aug. 23, 2019, 1 page.

*Primary Examiner* — Peter N Helvey
(74) *Attorney, Agent, or Firm* — Obln, McClelland, Maier & Neustadt, L.L.P.

(57) ABSTRACT

To provide a container bag 34 that can be manufactured easily by folding a sheet material 1 precisely along a folding line 11B. The sheet material 1 is prepared by bonding two films 2 and 3 together in a predetermined pattern, and the sheet material 1 comprises a plurality of cells 16 formed between the two films 2 and 3 while being joined to one another to be filled with fluid. A trunk portion 17 to be filled with a content is formed by bonding overlapping layers of a peripheral edge 9A of the folded sheet material 1. A bottom portion 13 of the container bag 34 is folded inwardly toward the trunk portion 17 along the folding line 11B. A non-bonded section 14 in which the two films 2 and 3 are not bonded together is maintained linearly within the folding line 11B.

12 Claims, 13 Drawing Sheets

(51) Int. Cl.
*B65D 75/58* (2006.01)
*B65D 81/38* (2006.01)

(58) Field of Classification Search
USPC ..... 383/116
See application file for complete search history.

(56) References Cited

U.S. PATENT DOCUMENTS 7,858,909 B2 * 12/2010 Jackson ..... B65D 81/3469 219/730
9,327,867 B2 * 5/2016 Stanley ..... B65D 11/10
10,457,457 B2 * 10/2019 Arent ..... B65D 85/70
2003/0108699 A1 6/2003 Tanaka
2004/0035865 A1 * 2/2004 Rosen ..... B65D 33/02 220/4.01
2004/0234174 A1 * 11/2004 Caudle ..... B29C 66/431 383/104
2007/0068118 A1 * 3/2007 Forss ..... B65D 75/563 53/403
2009/0169134 A1 7/2009 Hsu
2010/0061664 A1 * 3/2010 Gustafsson ..... B65D 75/5816 493/227
2013/0292287 A1 * 11/2013 Stanley ..... B65D 27/00 206/459.5
2014/0033654 A1 * 2/2014 Stanley ..... B65D 75/008 53/452
2015/0121810 A1 * 5/2015 Bourgeois ..... B65D 75/008 53/434
2015/0122373 A1 * 5/2015 Bourgeois ..... B65D 33/02 141/12
2015/0122840 A1 * 5/2015 Cox ..... B65D 47/20 222/213
2015/0122841 A1 * 5/2015 McGuire ..... B65D 31/16 222/206
2015/0122846 A1 * 5/2015 Stanley ..... B65D 75/54 222/206
2015/0126349 A1 * 5/2015 Ishihara ..... B31B 70/60 493/203
2016/0176578 A1 * 6/2016 Stanley ..... B65D 25/56 206/459.5
2016/0176582 A1 * 6/2016 McGuire ..... B65D 35/02 206/277
2016/0176583 A1 * 6/2016 Ishihara ..... B65B 3/04 53/452
2016/0176584 A1 * 6/2016 Ishihara ..... B65D 75/008 493/243
2016/0176597 A1 * 6/2016 Ishihara ..... B31B 70/00 493/243
2016/0221727 A1 * 8/2016 Stanley ..... B05B 11/0008
2016/0297569 A1 * 10/2016 Berg, Jr. ..... B65D 35/02
2016/0297589 A1 * 10/2016 You ..... B65D 75/52
2016/0297590 A1 * 10/2016 You ..... B65D 75/5872
2016/0297591 A1 * 10/2016 You ..... B65D 75/008
2016/0325518 A1 * 11/2016 Ishihara ..... B31B 70/26
2016/0362228 A1 * 12/2016 McGuire ..... B65D 75/008
2017/0001782 A1 * 1/2017 Arent ..... B65D 75/008

FOREIGN PATENT DOCUMENTS

CN 102099185 A 6/2011
CN 204056710 U 12/2014
CN 107107477 A 8/2017
EP 3 348 488 A1 7/2018
JP 2016-108034 A 6/2016
JP 2018-95267 A 6/2018
WO WO 2007/008021 A1 1/2007

* cited by examiner

CONTAINER BAG MADE OF SHEET MATERIAL

TECHNICAL FIELD

The present invention relates to a container bag made of a sheet material, and especially to a container bag formed by folding a sheet material formed of at least two films laminated together.

BACKGROUND ART

JP-A-2018-95267 describes one example of the bag of this kind. The bag of this kind is made of a sheet material prepared by laminating two films in such a manner as to form a plurality of cells communicated with one another. The bag of this kind is formed by folding the sheet material thus prepared, and each cell of the sheet material is filled with fluid to be inflated. Specifically, the sheet material is prepared by laminating two films, and the films are adhesively bonded together at longitudinal and lateral bonding sites extending intermittently so that each of the cells is defined by the longitudinal and the lateral bonding sites. An intermediate section of the sheet material in the longitudinal direction will be formed into a bottom of the bag. To this end, each lateral bonding sites on both sides of the intermediate section in the longitudinal direction is wider than the other lateral bonding sites, and individually divided into three parts in the lateral direction. Portions of the sheet material on both sides of the intermediate section are folded along the wider lateral bonding sites to be overlapped to each other, and the intermediate section is also folded along the lateral bonding sites extending between the wider lateral bonding sites such that the folded intermediate section is situated inside of the overlapped sheet material. Peripheral edges of the sheet material thus folded are bonded together so that a reservoir is formed in the bag to be filled with content.

JP-A-2016-108034 describes a container bag formed by folding laminate film into two layers. In the laminate film, a pair of partition sections extend laterally at an intermediate section of the laminate film, and a section between the partition sections serves as an easily folded section. Peripheral edges of the laminate film folded into two layers are bonded together, and the partition sections are also bonded together. The easily folded section comprises a belt-like non-bonded section in which the layers of the film are not bonded together, and a thin linear bonded section in which the layers of the film are bonded together. Therefore, the container bag may be folded easily along the easily folded section serving as a folding line.

SUMMARY OF INVENTION

Technical Problem to be Solved by the Invention

As a result of partially bonding the layers of the film, a thickness of the bonded section will be increased thicker than a thickness of each layer of the film in a non-bonded section. Consequently, section modulus, bending strength, and stiffness of the bonded layers of the film will be increased greater than those of each layer of the film in the non-bonded section. That is, it is difficult to bend the bonded layers of the film. Likewise, the bonding sites described in JP-A-2018-95267 are also difficult to be bent. For this reason, the sheet material may not be folded easily along a designed folding line. Specifically, the sheet material may be folded along a line different from the designed folding line. As a result, the layers of the sheet material may be bonded together at a site different from a designed site. That is, the bag may not be shaped into a designed configuration. Thus, a manufacturing accuracy of the bag described in JP-A-2018-95267 has to be improved.

On the other hand, according to the teachings of JP-A-2016-108034, the easily folded section is formed to allow the container bag to be folded easily. Therefore, even if the easily folded section is formed at a site slightly different from a designed site, manufacturability of the container bag may not be reduced.

The present invention has been conceived noting the foregoing technical problems, and it is therefore an object of the present invention to provide a container bag that can be manufactured easily by folding a sheet material precisely along a folding line.

Means for Solving the Problem

According to the present invention, there is provided a container bag made of sheet material. The sheet material is prepared by bonding two films together in a predetermined pattern, and the sheet material comprises a plurality of cells formed between the two films while being joined to one another to be filled with fluid. The container bag is formed by folding the sheet material along a predetermined folding line. The container bag comprises a trunk portion to be filled with a content, that is formed by bonding overlapping layers of a peripheral edge of the folded sheet material at least partially. A bottom portion of the container bag is folded inwardly toward the trunk portion along the folding line. In order to achieve the above-explained objective, according to the present invention, a non-bonded section in which the two films are not bonded together is maintained within the folding line.

According to the present invention, a bonding line at which the two films are bonded together may extend on the folding line, and the non-bonded section may be maintained linearly within the bonding line.

According to the present invention, the non-bonded section may be joined to the cells, and a pair of bonding lines at which the two films are bonded together may extend in parallel with each other on both sides of the non-bonded section. In addition, a width of the non-bonded section may be narrower than a width of a communication passage providing a communication between the cells.

According to the present invention, the non-bonded section may extend on the folding line continuously or intermittently.

According to the present invention, the folding line may include: a first folding line at which the bottom portion is folded to protrude inwardly toward the trunk portion; and a second folding line as a boundary between the trunk portion and the bottom portion at which the bottom portion is folded to protrude outwardly from the trunk portion. In addition, the non-bonded section is maintained at least within the first folding line.

Advantageous Effects of Invention

According to the present invention, the non-bonded section is maintained linearly on the folding line of the container bag. Since the two films are not bonded together in the non-bonded section, bending strength and stiffness of the non-bonded section are not enhanced. According to the present invention, therefore, the sheet material may be folded easily and accurately along the folding line. For this reason, the container bag may be accurately shaped into designed configurations. That is, manufacturability of the container bag may be improved.

DESCRIPTION OF EMBODIMENT(S)

The container bag according to the present invention is formed by folding a sheet material, and if the container bag is not filled with a content, the container bag may be compressed into a sheet shape. That is, volume of the container bag may be reduced. The sheet material is formed of at least two films, and a plurality of cells are formed between the films. The cells are filled with fluid to be inflated so that the container bag is shaped into a container. In addition, a temperature of the content held in the bag may be maintained by the fluid held in the cells.

First Example

Figure 1:
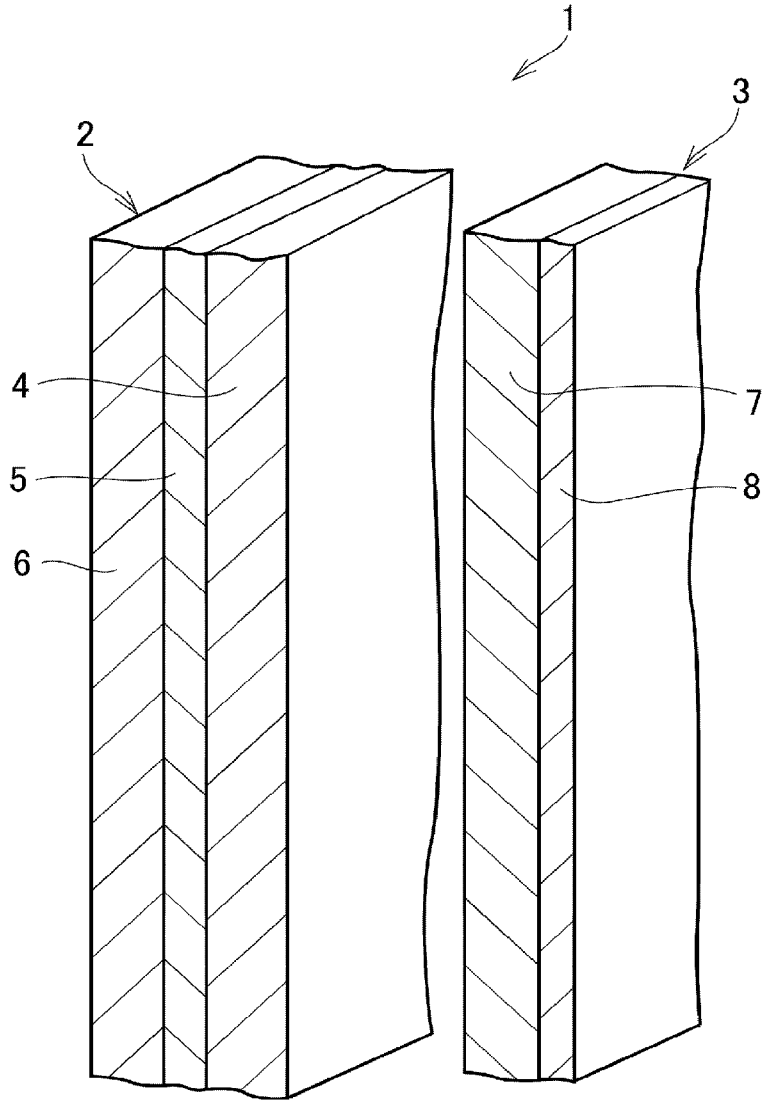
FIG. 1 is a perspective cross-sectional view showing cross-sections of films forming a sheet material of the container bag according to the present invention.

FIG. 1 is a perspective cross-sectional view showing cross-sections of films forming a sheet material of the container bag according to the present invention. The sheet material 1 shown in FIG. 1 comprises a first film 2 to be formed into an inner surface of the container bag, and a second film 3 to be formed into an outer surface of the container bag. The first film 2 and the second film 3 are laminated together. The first film 2 is a laminate film comprising an adhesion layer 4 that is bonded e.g., thermally to the second film 3, a barrier layer 5 that is laminated on the adhesion layer 4 to prevent permeation of gaseous matter, and an inner layer 6 that serves as the inner surface of the bag to be contacted to the content. In a case of thermally bonding the first film 2 to the second film 3, it is preferable to employ a heat-sealable resin film as the adhesion layer 4. In this case, for example, a resin film of polyolefin series, or a resin film of polyester series may be adopted as the adhesion layer 4. In order to improve adhesiveness of the adhesion layer 4, a resin film made of linear low-density polyethylene resin (to be abbreviated as LLDPE hereinafter) is especially suitable to be adopted as the adhesion layer 4.

The barrier layer 5 is adapted to prevent permeation of e.g., oxygen, moisture, aroma substance into the first film 2. To this end, a resin film or a resin coating having oxygen gas barrier property is adopted as the barrier layer 5 so that a permeability rate or amount of the oxygen gas into the first film 2 is reduced. In a case of employing the resin coating as the barrier layer 5, a coating material consisting mainly of synthetic resin having an oxygen barrier property or a moisture barrier property is applied to the adhesion layer 4 or the inner layer 6, and then, the coating material is dried to be solidified. For example, the resin film or the resin coating as a material of the barrier layer 5 may be made of ethylene-vinylalcohol copolymer. As the adhesion layer 4, it is preferable to employ a heat-sealable resin film of polyolefin series or polyester series as the inner layer 6, and a resin film of LLDPE is especially suitable as the inner layer 6.

The second film 3 comprises a base layer 7 as a base film, and an outer layer 8 that serves as an outer surface of the bag. The base layer 7 is thermally bonded to the first film 2, and is also formed of a heat-sealable resin film. As the adhesion layer 4, it is preferable to employ a resin film of polyolefin series or polyester series as the base layer 7, and a resin film of LLDPE is especially suitable as the base layer 7. Given that the resin film of LLDPE is employed as the base layer 7, the base layer 7 may be thermally bonded easier and more firmly to the adhesion layer 4, compared to a case of employing other films. That is, it is preferable to use the same material to form the base layer 7 and the adhesion layer 4. For example, it is preferable to employ a resin film of polyamide series, polyolefin series, or polyester series as the outer layer 8, and a resin film of nylon (registered trademark) resin is especially suitable as the outer layer 8.

Figure 2:
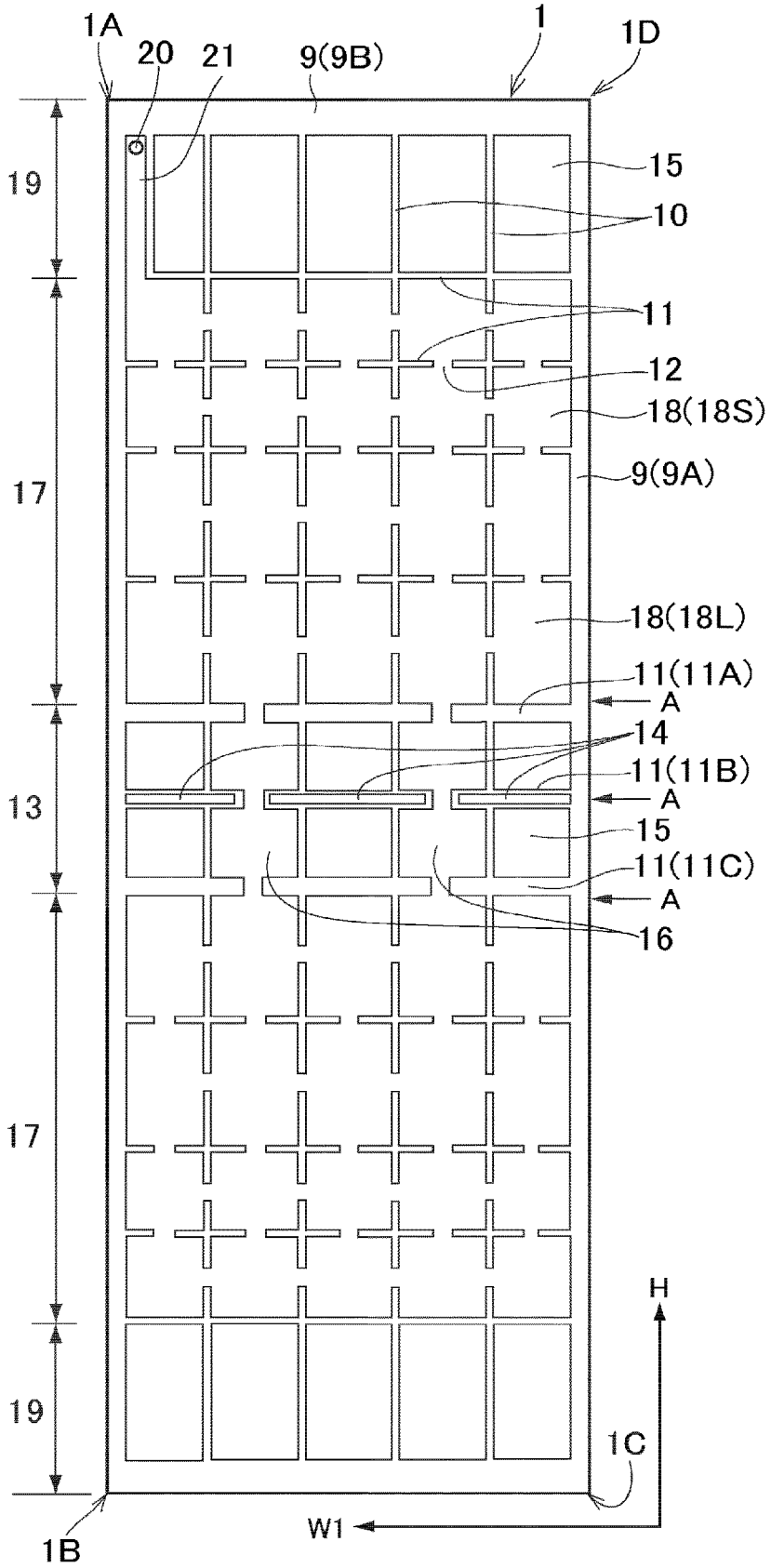
FIG. 2 is a plan view showing the sheet material of the container bag according to the first example.

FIG. 2 is a plan view showing the sheet material 1 of the container bag according to the first example. As illustrated in FIG. 2, the sheet material 1 is a rectangular sheet in which the first film 2 and the second film 3 are laminated together, and bonded together in a predetermined pattern. As described, the first film 2 and the second film 3 are bonded together by the heat-sealing method using e.g., a seat sealer. Specifically, the first film 2 and the second film 3 are overlapped together, and a pad having a predetermined pattern is pressed onto the first film 2 and the second film 3 while heating the pad. Otherwise, the pad which as been heated in advance is pressed onto the first film 2 and the second film 3 being overlapped together. Thereafter, the pad is isolated away from the first film 2 and the second film 3, and the first film 2 and the second film 3 are cooled. Instead of the heat-sealing method, the first film 2 and the second film 3 may also by bonded together by the ultrasonic bonding method to locally heat the bonding site. Yet, instead of the heat-sealing method, the first film 2 and the second film 3 may also by bonded together using an adhesive agent.

Here will be explained a bonding pattern of the sheet material 1. According to the example shown in FIG. 2, a peripheral edge 9 of the first film 2 and the second film 3 overlapped together is entirely bonded together. The peripheral edge 9 includes a pair of long edges 9A extending on long opposite sides of the sheet material 1 in a length direction H, and a pair of short edges 9B extending on short opposite sides of the sheet material 1 in a width direction W1. Within the area enclosed by the peripheral edge 9, the first film 2 and the second film 3 are bonded together at a plurality of longitudinal bonding lines 10 extending in the length direction H, and at a plurality of transverse bonding lines 11 extending in the width direction W1. That is, within the area enclosed by the peripheral edge 9, the first film 2 and the second film 3 are bonded together in a grid pattern.

Specifically, the longitudinal bonding lines 10 extend intermittently in the length direction H at certain intervals in the width direction W1. That is, clearances are maintained between the adjoining longitudinal bonding lines 10 in the length direction H. On the other hand, the transverse bonding lines 11 also extend intermittently in the width direction W1 at certain intervals in the length direction H. That is, clearances are also maintained between the adjoining transverse bonding lines 11 in the width direction W1. In other words, each array of the clearances between the adjoining longitudinal bonding lines 10 individually penetrates through a series of the longitudinal bonding lines 10 in the width direction W1, and each array of the clearances between the adjoining transverse bonding lines 11 individually penetrates through a series of the transverse bonding lines 11 in the length direction H. Accordingly, each of the clearances individually serves as a communication passage 12 providing a communication between adjacent spaces enclosed by the longitudinal bonding line 10 and the transverse bonding line 11. Each of the spaces enclosed by the longitudinal bonding line 10 and the transverse bonding line 11 serves as a cell of the present invention. It is preferable to set widths of the communication passage 12 as narrow as possible as long as the fluid is allowed to flow therethrough, based on an experimental result.

The bonding pattern of the sheet material 1 will be explained in more detail. In the sheet material 1, an intermediate section in the length direction H is defined as a first section 13 to be formed into a bottom portion of the container bag. In the first section 13, each of the longitudinal bonding lines 10 extends continuously in the length direction H. On the other hand, each of the transverse bonding line 11 extends intermittently in the width direction W1. In the example shown in FIG. 2, three transverse bonding lines 11 are drawn within the first section 13. Specifically, a first transverse bonding line 11A, a second transverse bonding line 11B, and a third transverse bonding line 11C extends from top down in FIG. 2. A width of each of the first transverse bonding line 11A, the second transverse bonding line 11B, and the third transverse bonding line 11C is individually thicker than a width of each of the transverse bonding lines 11 extending in other sections. The first transverse bonding line 11A and the third transverse bonding line 11C serve as a boundary between the first section 13 and after-mentioned second sections 17, respectively.

The second transverse bonding line 11B extends at a substantially intermediate portion of the first section 13 or the sheet material 1 in the width direction W1. A non-bonded section 14, in which the first film 2 and the second film 3 are not bonded together, is maintained in each of the second transverse bonding line 11B. Since the first film 2 and the second film 3 are not bonded together in the non-bonded section 14, section modulus, bending strength, and stiffness of the non-bonded section 14 are less than those of the section in which the first film 2 and the second film 3 are bonded together. Therefore, the sheet material 1 may be folded easily along the non-bonded section 14. A width of the non-bonded section 14 and a width of the second transverse bonding line 11B in which the non-bonded section 14 is maintained are set to values possible to bond the first film 2 to the second film 3 and possible to fold the sheet material 1 easily. Specifically, the width of the non-bonded section 14 is substantially identical to a thickness of an after-mentioned disc, and the width of the second transverse bonding line 11B is set based on an experimental result. Accordingly, the second transverse bonding line 11B serves as a first folding line of the present invention.

In the first section 13, six closed cells 15 are formed in total. Each of the closed cells 15 is enclosed by the transverse bonding lines 11 and the longitudinal bonding lines 10 or the longitudinal bonding line 10 and the long edge 9A. A pair of open cells adjacent to each other in the length direction H is formed between a pair of the closed cells 15 formed adjacent to one of the long edges 9A and a center pair of the closed cells 15. Likewise, a pair of open cells adjacent to each other in the length direction H is also formed between a pair of the closed cells 15 formed adjacent to other one of the long edges 9A and the center pair of the closed cells 15. In short, four open cells are formed in the first section 13 in total. In other words, the open cells are not formed on both width end sections and the central section of the first section 13. Those open cells serve as a bottom cell 16, respectively. As described, those four bottom cells 16 are not aligned on a common axis. That is, one pair of the bottom cells 16 are aligned on a common axis, but other two bottom cells 16 are not situated on the above-mentioned common axis. Therefore, when the bottom cells 16 are filled with the fluid, at least three bottom cells 16 are inflated to be contacted on a ground. Therefore, the container bag can be sustained stably by the inflated bottom cells 16.

Sections on both sides of the first section 13 in the length direction H are defined as second sections 17 to be formed into a trunk portion of the container bag. In the second sections 17, each of the longitudinal bonding lines 10 extends intermittently in the length direction H. Specifically, a length of each of the longitudinal bonding lines 10 is longer in a section close to the first section 13, but shorter in a section close to the short edge 9B. On the other hand, each of the transverse bonding line 11 also extends intermittently in the width direction W1 at substantially constant length. In each of the second sections 17, therefore, each of the open cells in the section close to the first section 13 is individually shaped into a rectangular shape that is longer in the length direction H. In the following explanations, the open cell in the second sections 17 will be referred to as the wall cell 18, and the open cell that is longer in the length direction H will be referred to as the long wall cell 18L. On the other hand, each of the open cells in the section close to the short edge 9B is individually shorter than the long wall cells 18L in the length direction H. In the following explanations, the open cell in the second section 17 that is shorter than the long wall cell 18L in the length direction H will be referred to as the short wall cell 18S. The wall cells 18 (18L, 18S) are connected to one another through the communication passages 12.

Sections on both sides of the second sections 17 in the length direction H are defined as third sections 19 to be formed into a shoulder portion of the container bag, and a spout (not shown) will be attached to the shoulder portion. In one of the third sections 19 above the first section 13 (i.e., in the upper side in FIG. 2), each of the longitudinal bonding lines 10 extends continuously in the length direction H from one of the short edges 9B at substantially constant length. On the other hand, the transverse bonding line 11 also extends continuously in the width direction W1 from one of the long edges 9A toward the other one of the long edges 9A.

In one of the third sections 19, five closed cells 15 are formed in total. Each of the closed cells 15 is enclosed by the transverse bonding line 11, the short edge 9B, and the longitudinal bonding lines 10 or the longitudinal bonding line 10 and the long edge 9A. In the five closed cells 15, dimensions of four of the closed cells 15 are substantially identical to one another, and a remaining one of the closed cells 15 is thinner than the other closed cells 15. In addition, a thin open cell extending in the length direction H is formed between the thin closed cells 15 and the other one of the long edges 9A. Specifically, the thin open cell is formed in the vicinity of one of corners 1A of the sheet material 1, and joined to the adjacent short wall cell 18S. An inlet hole 20 penetrating through the second film 3 in a thickness direction is formed in the thin open cell, and the fluid is injected into the open cells through the inlet hole 20. The fluid may be selected from water, air, nitrogen gas and so on. That is, the thin open cell serves as a flow path 21 in which the fluid flows from the inlet hole 20. For example, the inlet hole 20 may be a circular hole, a rectangular hole, a rhombic hole, and a triangle hole.

In other one of the third sections 19 below the first section 13 (i.e., in the lower side in FIG. 2), each of the longitudinal bonding lines 10 extends continuously in the length direction H from other one of the short edges 9B at substantially constant length. On the other hand, the transverse bonding line 11 also extends continuously in the width direction W1 from one of the long edges 9A to the other one of the long edges 9A. In other one of the third sections 19, five closed cells 15 are also formed in total. Each of the closed cells 15 is enclosed by the transverse bonding line 11, the short edge 9B, and the longitudinal bonding lines 10 or the longitudinal bonding line 10 and the long edge 9A. In other one of the third sections 19, dimensions of the closed cells 15 are substantially identical to one another.

Figure 3:
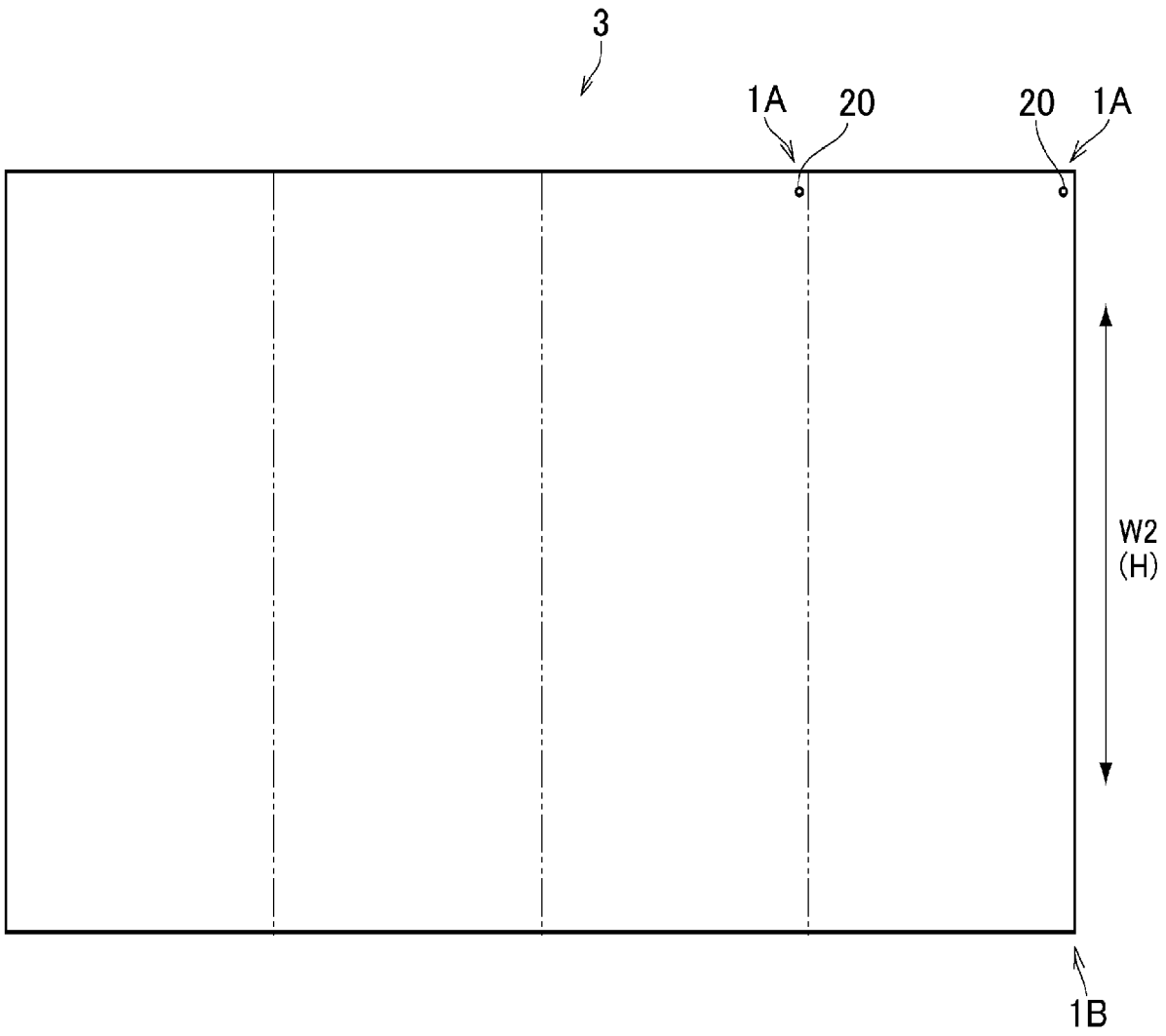
FIG. 3 is a plan view showing a second film in which an inlet hole is formed.

Next, here will be explained a manufacturing method of the sheet material 1, and a manufacturing method of the container bag using the sheet material. First of all, the second film 3 is fed from a roll in a predetermined length, and the inlet hole 20 is formed thereon. FIG. 3 shows the second film 3 in which the inlet hole 20 is formed. In FIG. 3, the arrow W2 indicates the length direction H of the sheet material 1. As shown in FIG. 3, the inlet hole 20 is formed on a predetermined site of the second film 3 corresponding to the corner 1A of the sheet material 1. The inlet hole 20 may be formed by a punching device (not shown) or a needle (not shown).

Figure 4:
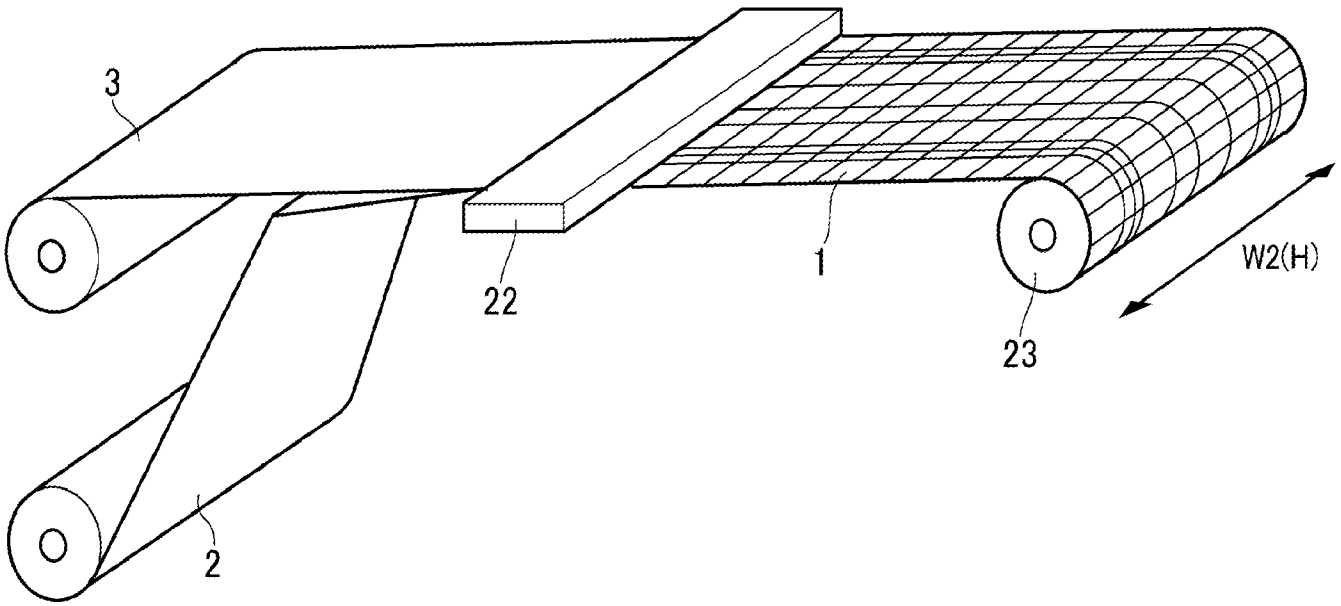
FIG. 4 is a perspective view showing one example of a laminating device for laminating a first film with the second film.

In the meantime, the first film 2 is fed from another roll in a predetermined length, and laminated on the second film 3 in which the inlet hole 20 has been formed. For example, as illustrated in FIG. 4, the base layer 7 of the second film 3 is laminated on the adhesion layer 4 of the first film 2. Thereafter, the first film 2 and the second film 3 are bonded together in the pattern shown in FIG. 2 by a heat-sealer 22. A resultant laminated sheet is rolled to form a rolled material 23.

Figure 5:
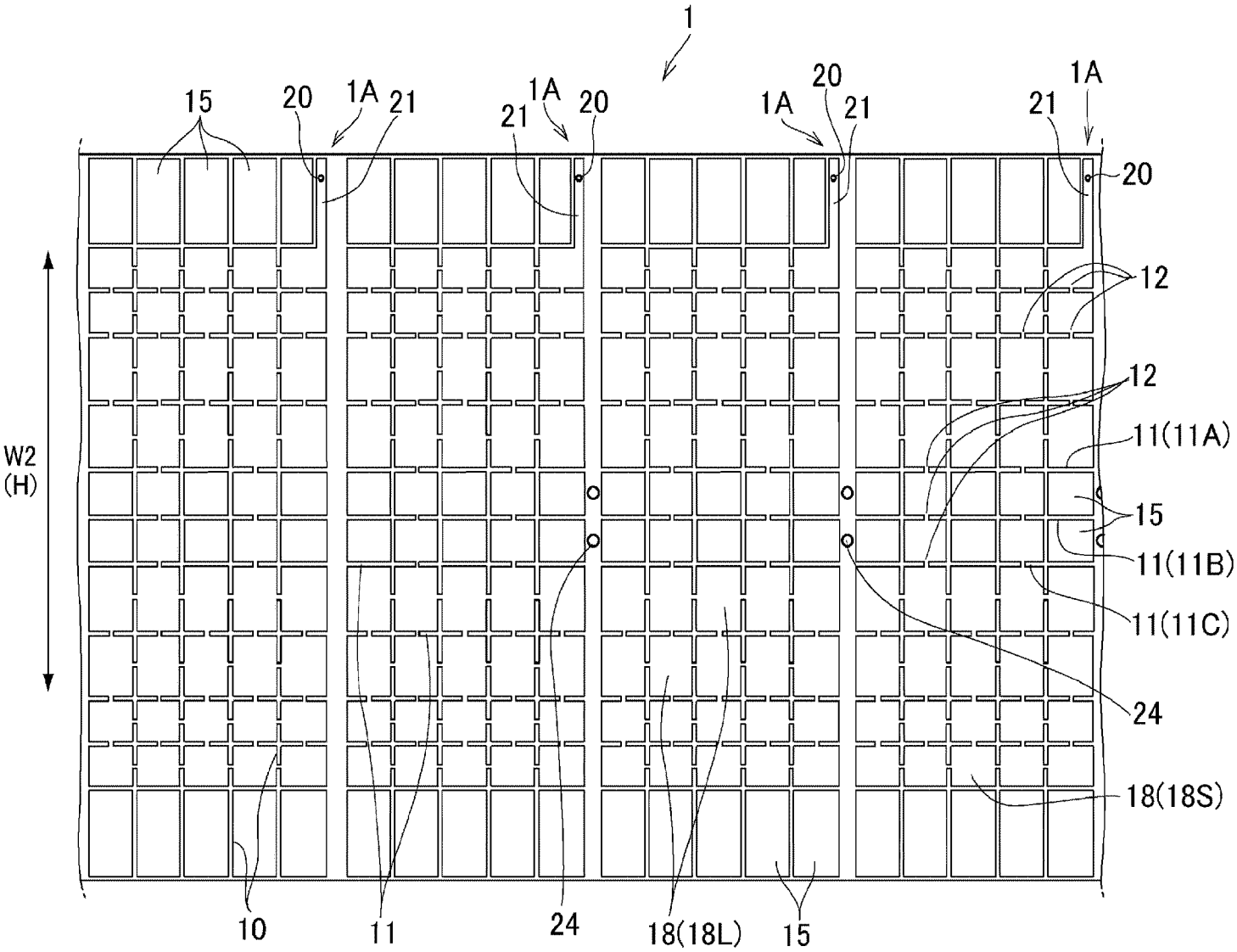
FIG. 5 is a plan view showing the sheet material in which cutouts are formed.

The rolled material 23 is set on a bag forming machine (not shown), and the sheet material 1 is fed from the rolled material 23 in a predetermined length as illustrated in FIG. 5. Then, a plurality of cutouts 24 are formed on the sheet material 1. Specifically, as illustrated in FIG. 5, a pair of the cutouts 24 is formed on the long edge 9A extending between the sheet materials 1 symmetrically across the second transverse bonding line 11B of the sheet material 1. For example, the cutouts 24 may be formed by a punching machine (not shown). As described later, when the first section 13 is folded into two layers along the second transverse bonding line 11B, the cutouts 24 are overlapped onto each other.

Figure 6:
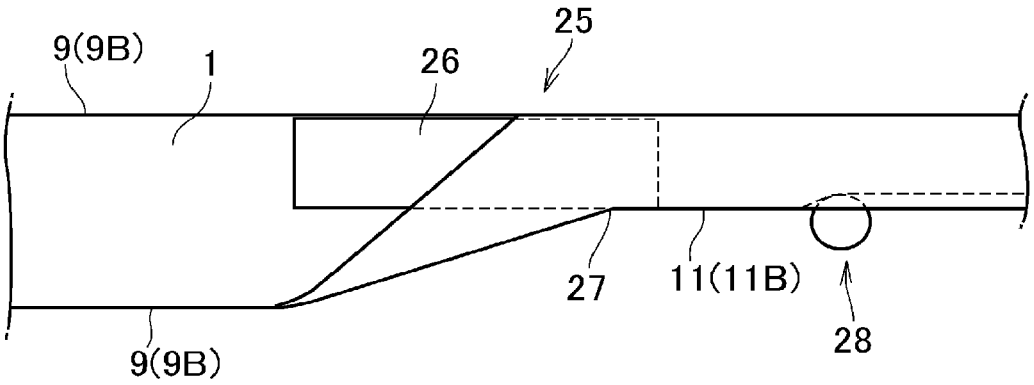
FIG. 6 is a schematic illustration showing one example of a folding device.

Then, the sheet material 1 is folded into two layers. One example of a folding device 25 to fold the sheet material 1 is shown in FIG. 6. The folding device 25 shown in FIG. 6 comprises a guide plate 26 arranged along the sheet material 1. The guide plate 26 comprises a guide portion 27 to which the second transverse bonding line 11B of the sheet material 1 is contacted so that the sheet material 1 starts being folded. To this end, the guide portion 27 and the second transverse bonding line 11B are aligned with each other. Specifically, the sheet material 1 is folded into two layers in such a manner that one of the short edges 9B is laminated on the other one of the short edges 9B.

Here will be explained an action of the folding device 25. The sheet material fed from the rolled material 23 is conveyed along the guide plate 26, and the sheet material 1 is folded into two layers by overlapping one of the short edges 9B onto the other one of the short edges 9B. Consequently, the second transverse bonding line 11B is brought into contact to the guide portion 27. As described, since the non-bonded section 14 is maintained within the second transverse bonding line 11B, the section modulus, the bending strength, and the stiffness of the non-bonded section 14 are less than those of the second transverse bonding line 11B. Therefore, the sheet material 1 is folded along the non-bonded section 14. Since the sheet material 1 is fed from the rolled material 23 continuously, the sheet material 1 is folded into two layers continuously along the non-bonded section 14 being contacted to the guide portion 27. For this reason, the sheet material 1 will be folded accurately into two layers as designed, without being folded at a portion other than the non-bonded section 14.

Figure 7:
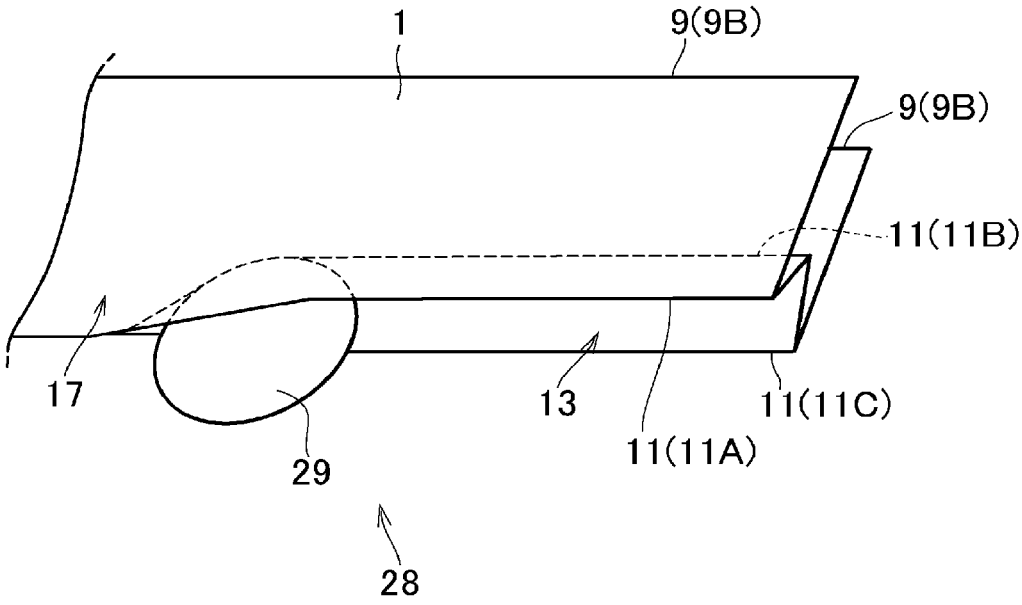
FIG. 7 is a schematic illustration showing one example of an accordion-folding device.

An accordion-folding device 28 is disposed downstream of the folding device 25 in a feeding direction of the sheet material 1. One example of the accordion-folding device 28 is shown in FIG. 7. The accordion-folding device 28 folds the sheet material 1 partially into four layers by pushing the first section 13 to be formed into the bottom portion of the container bag toward the second sections 17 of the layers of the sheet material 1 which has been folded into two layers by the folding device 25. To this end, the accordion-folding device 28 comprises: a spacer (not shown) that is inserted between the layers of the sheet material 1 which has been folded into two layers by the folding device 25 to widen a clearance between the layers of the sheet material 1; and a disc 29 that is contacted to the sheet material 1 which has been folded into two layers from outside. For example, a pair of pins or bars may be adopted as the spacer. In this case, the spacer is inserted between the layers of the sheet material 1, and a clearance between the pins or bars is widened to widen the clearance between the layers of the sheet material 1 from inside. Then, the first section 13 of the sheet material 1 folded into two layers in which the clearance between the layers of the sheet material 1 is widened is brought into contact to the disc 29 so that the first section 13 is pushed inwardly by the disc 29. Consequently, the first section 13 is folded into two layers inwardly to be laminated with the second sections 17 of the layers of the sheet material 1. That is, the sheet material 1 is partially into four layers to form the bottom of the container bag. In order to fold the non-bonded section 14 easily by contacting the disc 29, a thickness of the disc 29 is substantially identical to or thinner than a width of the non-bonded section 14. In addition, the disc 29 is arranged in such a manner as to push the second transverse bonding line 11B toward the short edges 9B of the sheet material 1 folded into two layers, in a length between the second transverse bonding line 11B and the first transverse bonding line 11A or the third transverse bonding line 11C. In order to limit frictional damage on the sheet material 1, the disc 29 may be allowed to rotate.

Here will be explained an action of the accordion-folding device 28. First of all, the above-mentioned spacer is inserted between the layers of the sheet material 1 which has been folded into two layers by the folding device 25, and the clearance between the layers of the sheet material 1 is widened by widening the clearance between the pins or bars of the spacer. Consequently, the first section 13 of the sheet material 1 which has been folded into two layers is expanded by the spacer. Then, the second transverse bonding line 11B comes into contact to the disc 29 so that the non-bonded section 14 maintained within the second transverse bonding line 11B is pushed toward the short edges 9B by the disc 29. As a result, the first section 13 is folded into two layers again along the non-bonded section 14 in such a manner as to protrude toward the second sections 17. That is, the first section 13 thus folded into two layers is situated between the layers of the second sections 17 to be formed into the trunk of the container bag.

As shown in FIG. 7, as a result of folding the first section 13 inwardly into two layers, a boundary between the first transverse bonding line 11A and the second sections 17 and a boundary between the third transverse bonding line 11C and the second sections 17 are projected outwardly. That is, as a result of pushing the second transverse bonding line 11B toward the overlapping short edges 9B of the sheet material 1 folded into two layers, the sheet material 1 is folded again along the above-mentioned boundaries at which the first film 2 and the second film 3 are not bonded together. Thus, the boundary between the first transverse bonding line 11A and the second sections 17, and the boundary between the third transverse bonding line 11C and the second sections 17 serve as a folding line respectively. Those folding lines are represented as "A" in FIG. 2.

Figure 8:
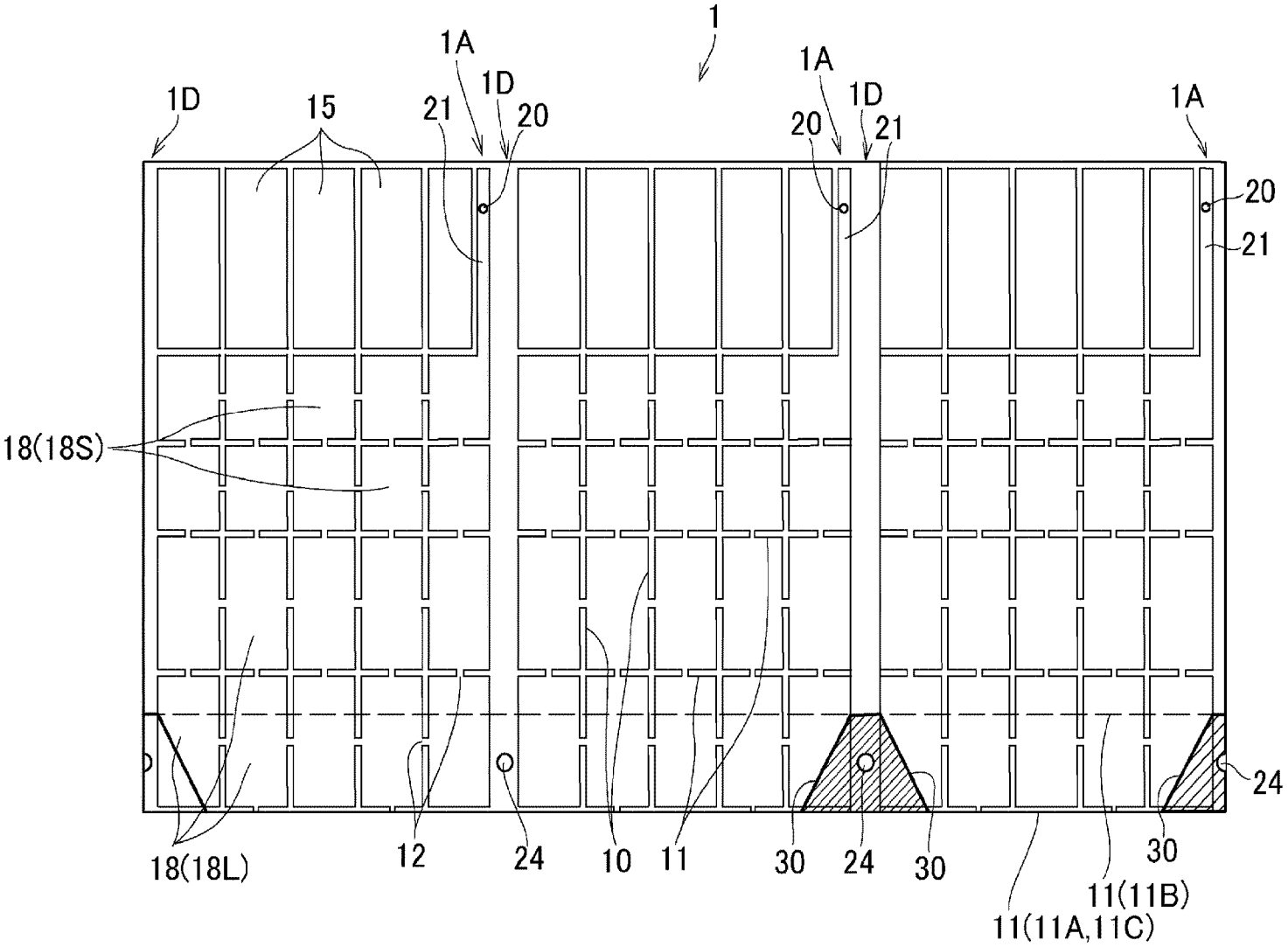
FIG. 8 is a plan view schematically showing a diagonal bonding line.

Then, each pair of the inner layers 6 being opposed to each other in the section of the sheet material 1 folded into four layers are partially bonded together. Specifically, as illustrated in FIG. 8, each pair of the inner layers 6 being opposed to each other in the area of the sheet material 1 folded into four layers are bonded together along a diagonal of the hatched trapezoidal area. Consequently, a pair of triangle flaps is formed on each bottom corner of the container bag. In the following explanations, the diagonal of the hatched trapezoidal area will be referred to as the diagonal bonding line 30. Since each pair of the inner layers 6 in the four layers are bonded together along the diagonal bonding line 30 on both sides of the width ends of the container bag, the bottom of the container bag will not be expanded excessively even after the container bag is filled with the content.

Figure 9:
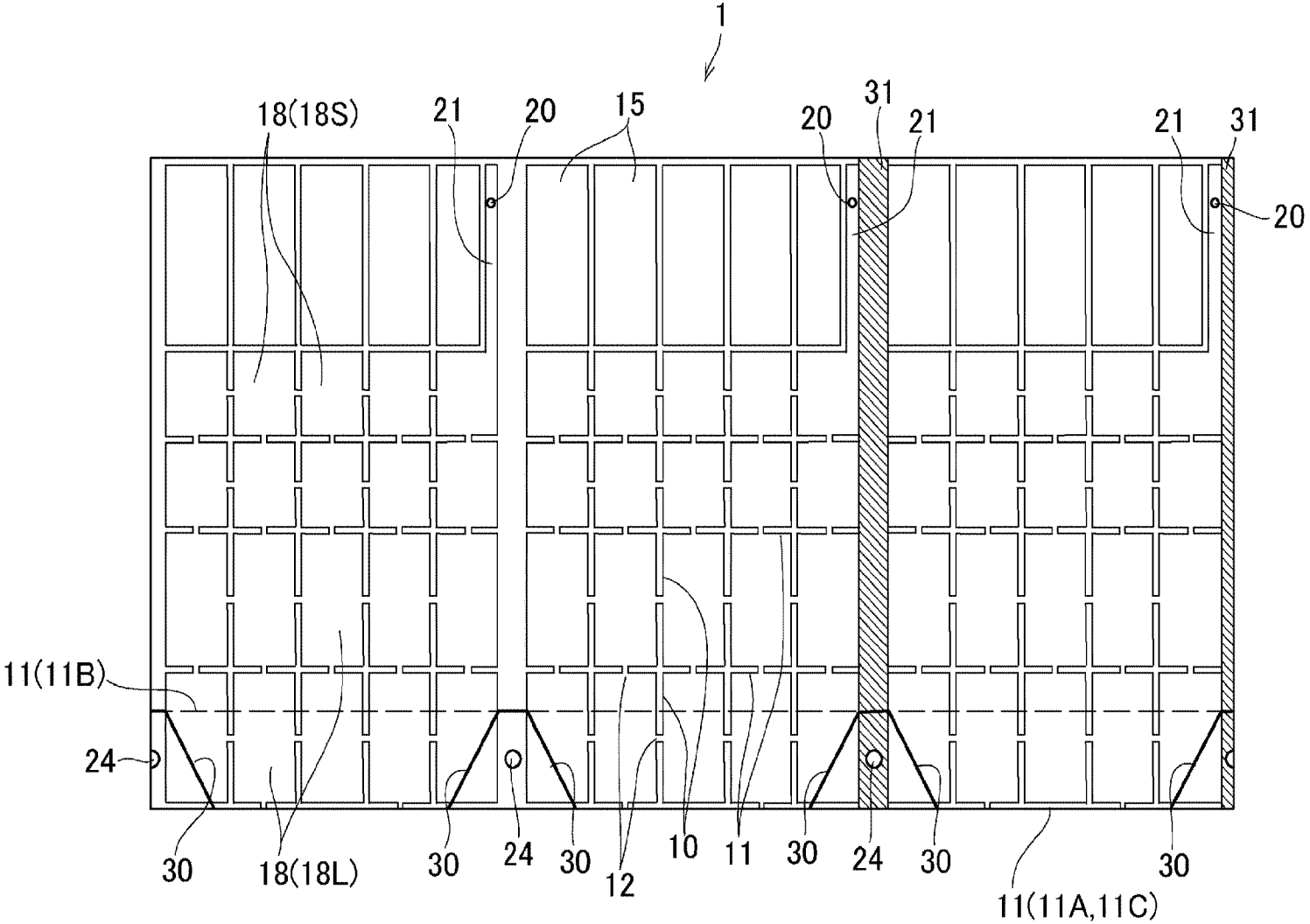
FIG. 9 is a plan view schematically showing a side sealing line.

Then, the long edges 9A overlapped on each other in the sheet material 1 folded in the above-explained manner is bonded together along a side sealing line 31 indicated by the hatched area shown in FIG. 9. As a result, the inner layers 6 being opposed to each other through the cutouts 24 overlapped onto each other are bonded together, and the above-mentioned flaps are also bonded together.

Figure 10:
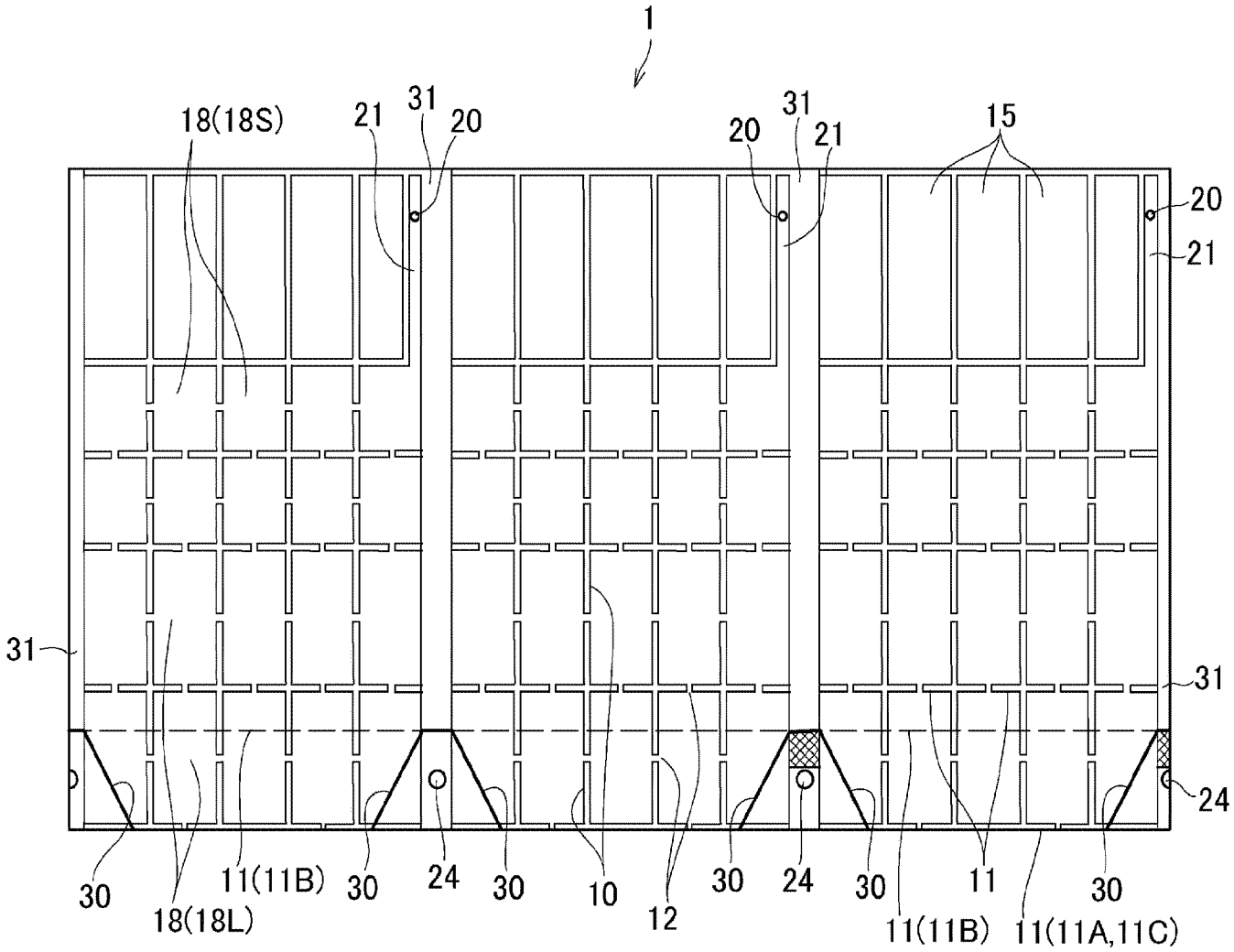
FIG. 10 is a plan view showing a site at which a local bonding takes place.
Figure 11:
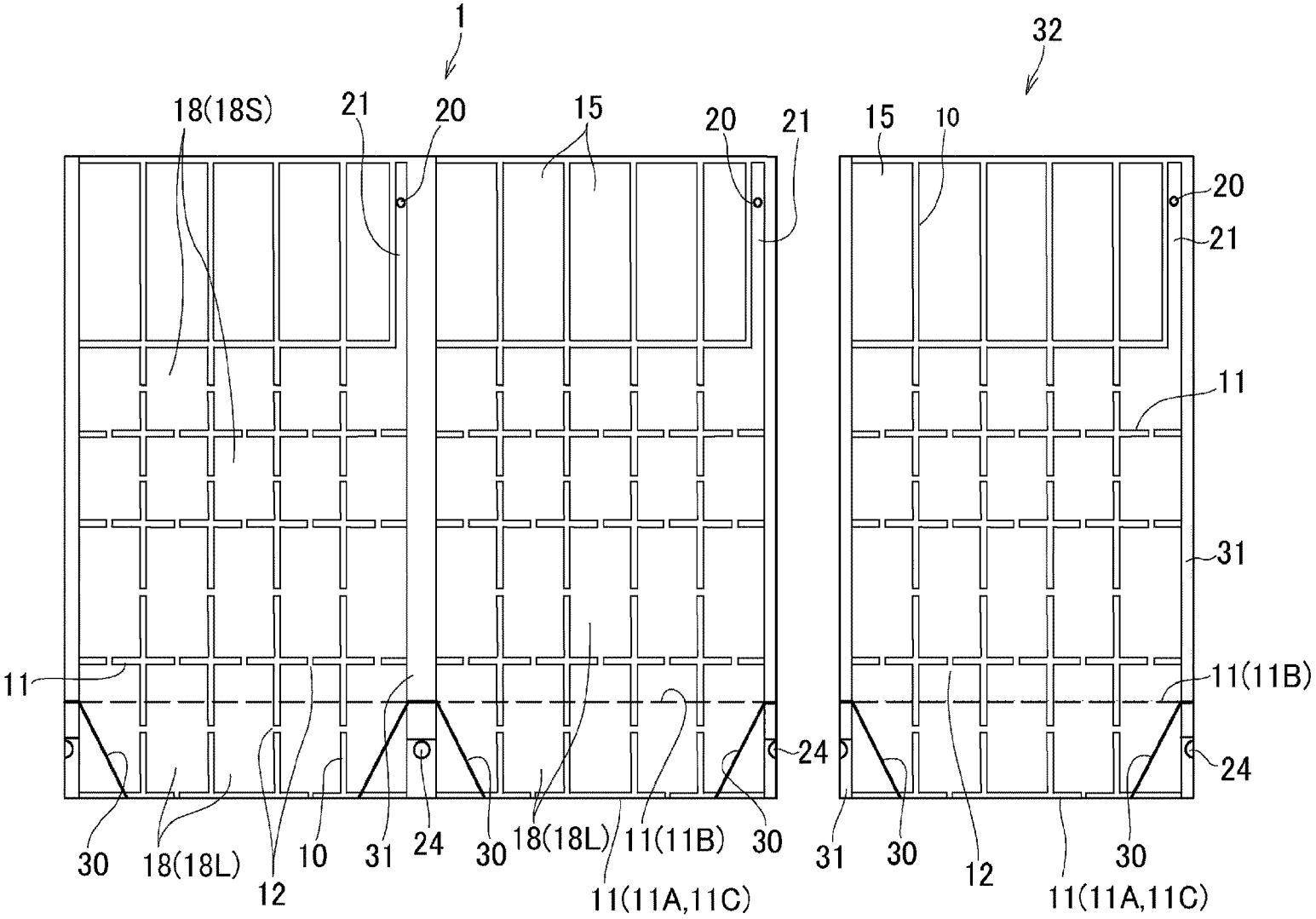
FIG. 11 is a plan view showing a bag material detached along the side sealing line.

Then, the four layers of the sheet material 1 at an intersection between an inner end of the diagonal bonding line 30 the side sealing line 31 are locally bonded together. Specifically, the four layers of the sheet material 1 are tightly bonded together locally at the hatched area shown in FIG. 10. As a result, a bag material 32 is formed, and as illustrated in FIG. 11, the bag material 32 is detached from the following sheet material 1 by cutting the side sealing line 31.

Figure 12:
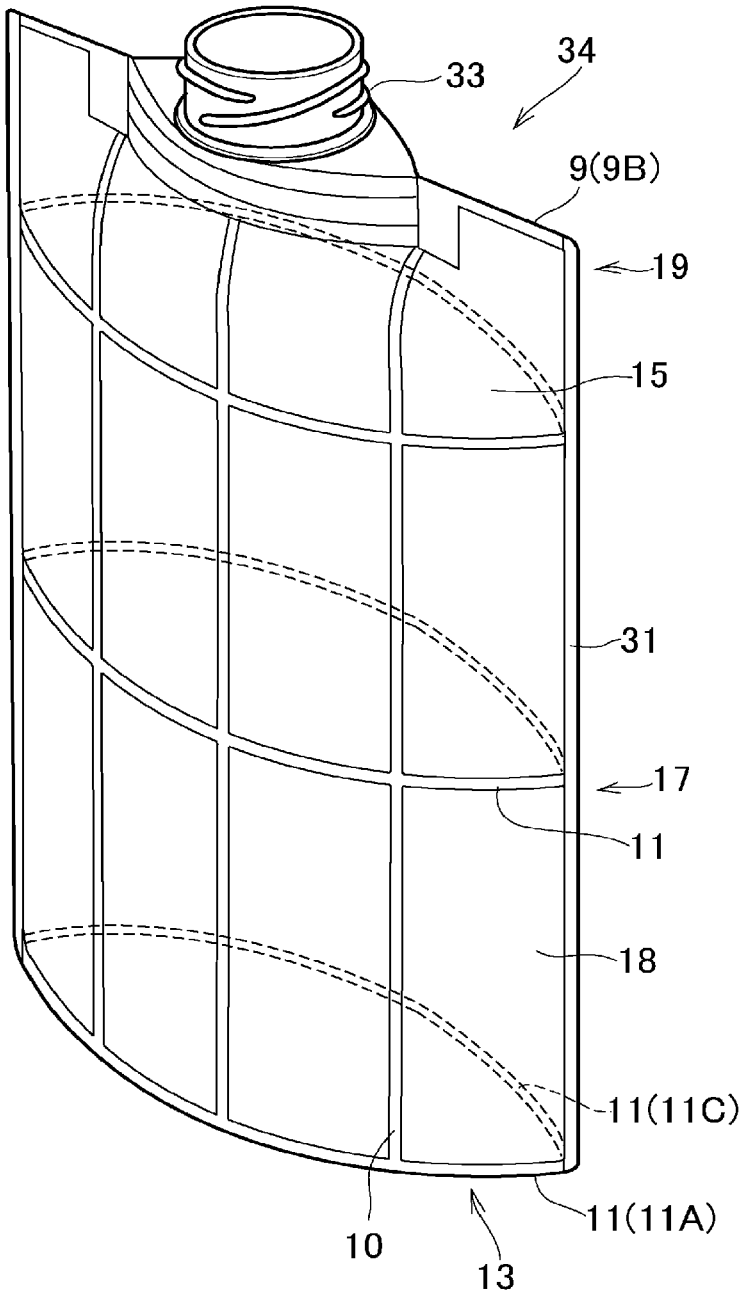
FIG. 12 is a perspective view schematically showing one example of the container bag on which a spout is mounted.

The bag material 32 is set on a spout attaching device (not shown), and a spout 33 is attached to an opening (not shown) of the bag material 32. For example, in the opening of the bag material 32, the spout 33 is placed between the short edges 9B situated above the third section 19, and the spout 33 and the short edges 9B are pressed together while being heated. Consequently, the spout 33 and the inner layers 6 of the short edges 9B are bonded together, and the inner layers 6 of the short edges 9B on both sides of the spout 33 are also bonded together to seal the opening. As a result, the sheet material 1 is formed into the container bag 34 shown in FIG. 12. In FIG. 12, the diagonal bonding lines 30 and the flaps are omitted for the sake of illustration.

The container bag 34 is set on a filling machine (not shown), and the content is filled into the trunk of the container bag 34 through the spout 33. For example, the container bag 34 may be filled with liquid or slurry content. After filling the container bag 34 with the content, a cap (not shown) is mounted on the spout 33 to close the spout 33. Then, fluid is injected into the cells by inserting a (not shown) nozzle into the inlet hole 20. Thereafter, the flow path 21 is closed by bonding the inner layers 6 together at downstream of the inlet hole 20, by pressing a heated bar onto the flow path 21 at downstream of the inlet hole 20, or by sandwiching the flow path 21 by a pair of heated bars at downstream of the inlet hole 20.

Thus, when folding the sheet material 1 along the second transverse bonding line 11B into two layers to form the container bag 34, the sheet material 1 is folded preferentially along the non-bonded section 14, but not along any other portion. After folding the sheet material 1 along the second transverse bonding line 11B, therefore, the first corner 1A and a second corner 1B can be overlapped accurately onto each other, and a third corner 1C and a fourth corner 1D can be overlapped accurately onto each other. For this reason, the bag material 32 and the container bag 34 may be accurately shaped into designed configurations. Therefore, the spout 33 may be attached accurately to a designed site, and the inlet hole 20 may be situated accurately at a designed site where the nozzle is inserted to inject the fluid into the cells. In addition, since the container bag 34 is formed by folding the sheet material 1 accurately along the designed folding line, displacement of the bonding sites resulting from vibrations and manufacturing errors may be reduced as much as possible. That is, manufacturability of the container bag 34 may be improved.

Second Example

Figure 13:
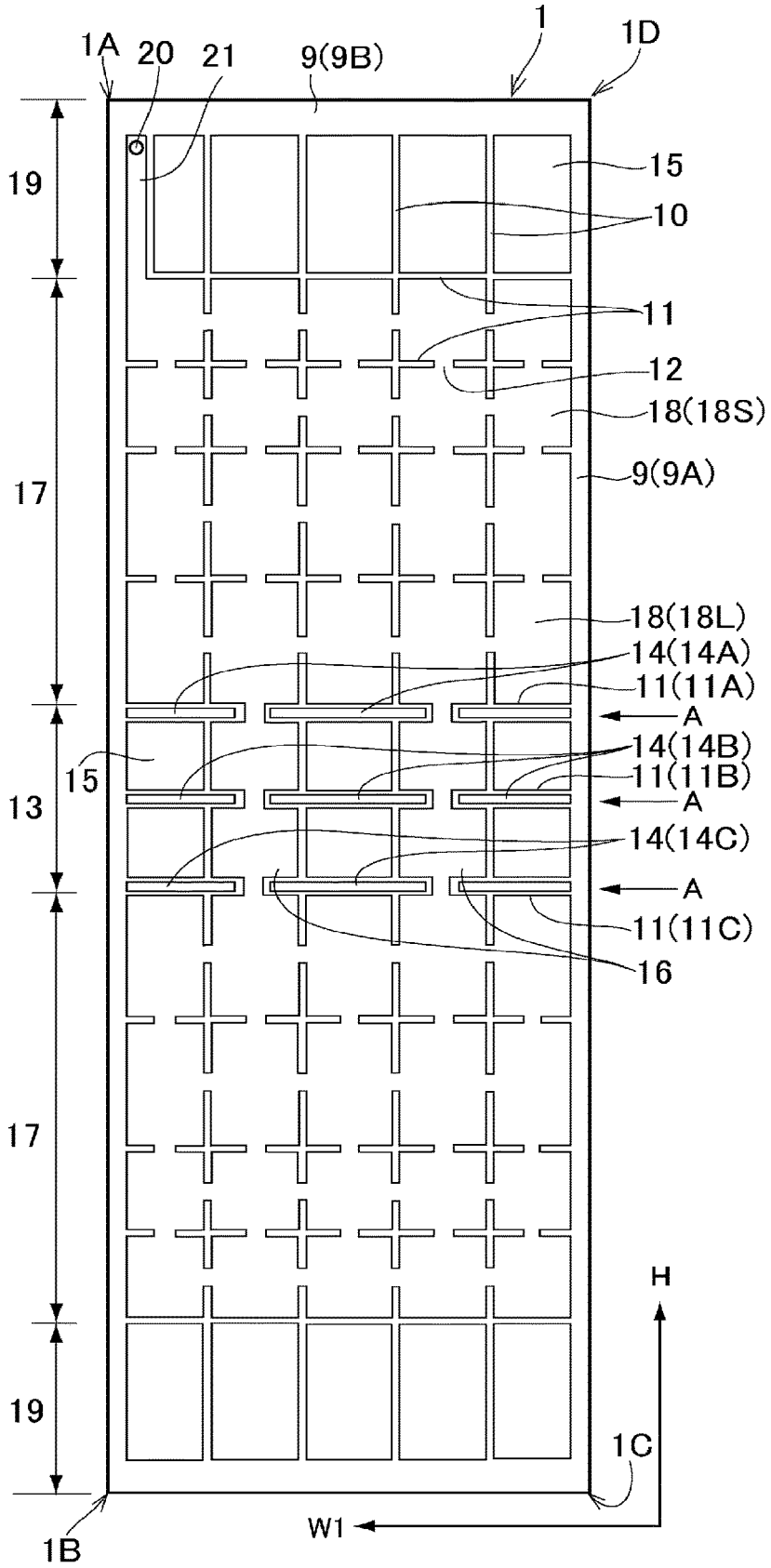
FIG. 13 is a plan view showing the sheet material of the container bag according to the second example.

FIG. 13 is a plan view showing the sheet material 1 according to the second example of the present invention in which the non-bonded section 14 is maintained in the first transverse bonding line 11A, the second transverse bonding line 11B, and the third transverse bonding line 11C, respectively. Specifically, a first non-bonded section 14A is maintained in the first transverse bonding line 11A, a second non-bonded section 14B is maintained in the second transverse bonding line 11B, and a third non-bonded section 14C is maintained in the third transverse bonding line 11C. Widths of the non-bonded sections 14A, 14B, and 14C, and the transverse bonding lines 11A, 11B, and 11C are set to values possible to bond layers of the folded transverse bonding lines together, and to fold the sheet material 1 easily along the non-bonded sections. For example, the width of each of the non-bonded sections 14A, 14B, and 14C may be set substantially identical to the thickness of the above-mentioned disc 29, respectively. The remaining configurations of the sheet material 1 according to the second example are similar to those of the sheet material 1 shown in FIG. 2, therefore, explanations for the configurations in common with those of the sheet material 1 shown in FIG. 2 will be omitted. Accordingly, the second transverse bonding line 11B serves as the first folding line of the present invention, and the first transverse bonding line 11A and the third transverse bonding line 11C serve as a second folding line of the present invention, respectively.

The sheet material 1 shown in FIG. 13 is also folded into two layers along the second non-bonded section 14B by the guide plate 26 of the folding device 25. Then, the first section 13 of the sheet material 1 which has been folded into two layers is pushed inwardly toward the short edges 9B of the sheet material 1 folded into two layers by the disc 29 of the accordion-folding device 28. Eventually, the first section 13 is folded inwardly into two layers along the second non-bonded section 14B. In this situation, the first non-bonded section 14A and the third non-bonded section 14C at which the bending strength and the stiffness are low serve as a folding line, respectively. According to the second example, therefore, the container bag 34 may also be accurately shaped into designed configurations by folding the sheet material 1 along the designed folding line. That is, manufacturability of the container bag 34 may also be improved.

Third Example

Figure 14:
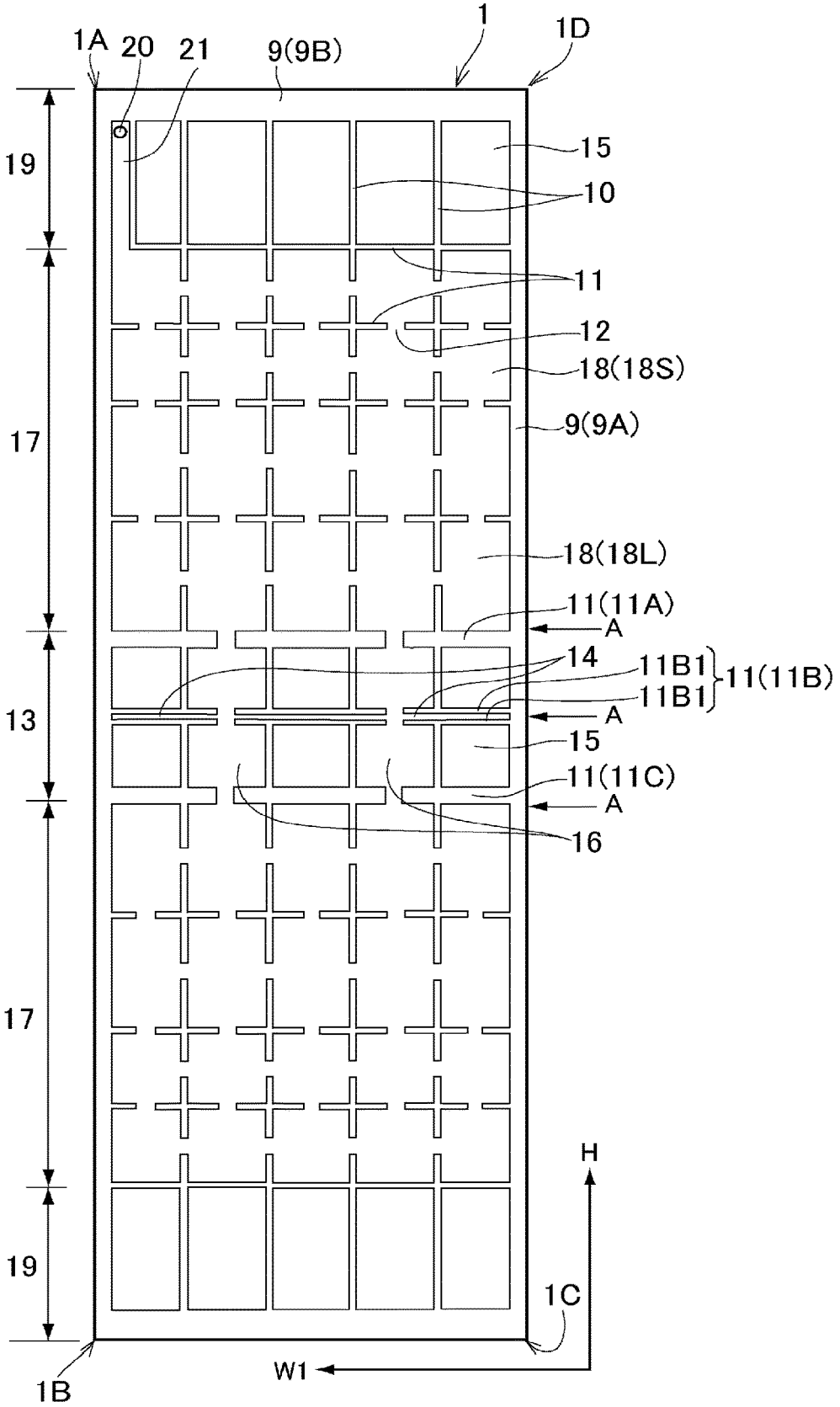
FIG. 14 is a plan view showing the sheet material of the container bag according to the third example.

FIG. 14 is a plan view showing the sheet material 1 according to the third example of the present invention in which the non-bonded section 14 is formed in such a manner as to penetrate through the second transverse bonding line 11B in the width direction W1. Specifically, the second transverse bonding line 11B comprises a pair of thin transverse bonding lines 11B1, and the non-bonded section 14 is maintained between the thin transverse bonding lines 11B1. The non-bonded section 14 is joined to the communication passage 12 so that the fluid is supplied to the cells through the communication passage 12. A width of each of the thin transverse bonding lines 11B1 is set to a value possible to bond the first film 2 and the second film 3 together, and a width of the non-bonded section 14 is set substantially identical to or slightly narrower than a width of the communication passage 12. Instead, the width of the non-bonded section 14 may also be set substantially identical to the thickness of the above-mentioned disc 29. Thus, in order to form a folding line accurately at a designed site, the width of the non-bonded section 14 is set as narrow as possible. If the width of the non-bonded section 14 is too wide, the bottom cells 16 would be deformed undesirably when the non-bonded section 14 is filled with the fluid to be inflated, and a portion other than the bottom cells 16 would be contacted to the ground. The remaining configurations of the sheet material 1 according to the third example are similar to those of the sheet material 1 shown in FIG. 2, therefore, explanations for the configurations in common with those of the sheet material 1 shown in FIG. 2 will be omitted.

The sheet material 1 shown in FIG. 14 is also folded into two layers along the non-bonded section 14 by the guide plate 26 of the folding device 25. Then, the first section 13 of the sheet material 1 which has been folded into two layers is pushed inwardly toward the short edges 9B of the sheet material 1 folded into two layers by the disc 29 of the accordion-folding device 28. Eventually, the first section 13 is folded inwardly into two layers along the non-bonded section 14. In this situation, the sheet material 1 is folded along the boundary between the first transverse bonding line 11A and the second sections 17, and the boundary between the third transverse bonding line 11C and the second sections 17, at which the bending strength and the stiffness are individually low. According to the third example, therefore, the container bag 34 may also be accurately shaped into designed configurations by folding the sheet material 1 along the designed folding line. That is, manufacturability of the container bag 34 may also be improved.

The present invention should not be limited to the described foregoing examples, and number configurations of the non-bonded section 14 may be altered within the scope of the present invention. For example, in the third example shown in FIG. 14, the non-bonded section 14 may also be formed to penetrate through the first transverse bonding line 11A and the third transverse bonding line 11C in the width direction W1, in addition to the second transverse bonding line 11B. The non-bonded section 14 may also be formed in a dot-like manner or formed intermittently at certain intervals, instead of forming the non-bonded section 14 continuously. Otherwise, the non-bonded section 14 may also be formed to extend only in half area of the sheet material 1. That is, the non-bonded section 14 may be modified arbitrarily as long as the sheet material 1 can be folded along the non-bonded section 14.

The invention claimed is:

1. A container bag made of sheet material,
wherein the sheet material is prepared by bonding two films together in a predetermined pattern,
the sheet material comprises a plurality of cells formed between the two films while being joined to one another to be filled with fluid,
the container bag is formed by folding the sheet material along a predetermined folding line,
the container bag comprises a trunk portion to be filled with a content, that is formed by bonding overlapping layers of a peripheral edge of the folded sheet material at least partially,
a bottom portion of the container bag is folded inwardly toward the trunk portion along the folding line,
the container bag includes a non-bonded section maintained within the folding line in which the two films are not bonded together,
the two films are bonded together at a bonding line that has a predetermined width, and
the non-bonded section is positioned within the bonding line and the non-bonded section is sealed with respect to the cells.

2. The container bag made of the sheet material as claimed in claim 1,
wherein the bonding line at which the two films are bonded together extends on the folding line, and
the non-bonded section is maintained linearly within the bonding line.

3. The container bag made of the sheet material as claimed in claim 1,
wherein the non-bonded section is joined to the cells,
a pair of bonding lines at which the two films are bonded together extends in parallel with each other on both sides of the non-bonded section, and
a width of the non-bonded section is narrower than a width of a communication passage providing a communication between the cells.

4. The container bag made of the sheet material as claimed in claim 1, wherein the non-bonded section extends on the folding line continuously or intermittently.

5. The container bag made of the sheet material as claimed in claim 1, wherein the folding line includes a first folding line at which the bottom portion is folded to protrude inwardly toward the trunk portion, and a second folding line as a boundary between the trunk portion and the bottom portion at which the bottom portion is folded to protrude outwardly from the trunk portion, and the non-bonded section is maintained at least within the first folding line.

6. The container bag made of the sheet material as claimed in claim 2, wherein the non-bonded section extends on the folding line continuously or intermittently.

7. The container bag made of the sheet material as claimed in claim 3, wherein the non-bonded section extends on the folding line continuously or intermittently.

8. The container bag made of the sheet material as claimed in claim 2, wherein the folding line includes a first folding line at which the bottom portion is folded to protrude inwardly toward the trunk portion, and a second folding line as a boundary between the trunk portion and the bottom portion at which the bottom portion is folded to protrude outwardly from the trunk portion, and the non-bonded section is maintained at least within the first folding line.

9. The container bag made of the sheet material as claimed in claim 3, wherein the folding line includes a first folding line at which the bottom portion is folded to protrude inwardly toward the trunk portion, and a second folding line as a boundary between the trunk portion and the bottom portion at which the bottom portion is folded to protrude outwardly from the trunk portion, and the non-bonded section is maintained at least within the first folding line.

10. The container bag made of the sheet material as claimed in claim 4, wherein the folding line includes a first folding line at which the bottom portion is folded to protrude inwardly toward the trunk portion, and a second folding line as a boundary between the trunk portion and the bottom portion at which the bottom portion is folded to protrude outwardly from the trunk portion, and the non-bonded section is maintained at least within the first folding line.

11. The container bag made of the sheet material as claimed in claim 6, wherein the folding line includes a first folding line at which the bottom portion is folded to protrude inwardly toward the trunk portion, and a second folding line as a boundary between the trunk portion and the bottom portion at which the bottom portion is folded to protrude outwardly from the trunk portion, and the non-bonded section is maintained at least within the first folding line.

12. The container bag made of the sheet material as claimed in claim 7, wherein the folding line includes a first folding line at which the bottom portion is folded to protrude inwardly toward the trunk portion, and a second folding line as a boundary between the trunk portion and the bottom portion at which the bottom portion is folded to protrude outwardly from the think portion, and the non-bonded section is maintained at least within the first folding line.

* * * * *